US007882949B1

(12) United States Patent
Singh

(10) Patent No.: US 7,882,949 B1
(45) Date of Patent: Feb. 8, 2011

(54) TOOTHBRUSH HOLDER APPARATUS

(76) Inventor: Mahamanie Singh, 97-45 107th St., Ozone Park, NY (US) 11416

( * ) Notice: Subject to any disclaimer, the term of this patent is extended or adjusted under 35 U.S.C. 154(b) by 0 days.

(21) Appl. No.: 12/574,036

(22) Filed: Oct. 6, 2009

(51) Int. Cl.
*B65D 83/10* (2006.01)
*B65D 81/24* (2006.01)
*A47B 81/02* (2006.01)

(52) U.S. Cl. ..... 206/361; 206/209.1; 211/65

(58) Field of Classification Search ..... 206/362.1, 206/209.1, 151, 361, 461, 466, 462, 463, 206/486, 488, 531–533; 211/65, 66, 60.1; 248/110, 316; 132/308, 310; 312/206, 209
See application file for complete search history.

(56) References Cited

U.S. PATENT DOCUMENTS 3,727,748 A 4/1973 Brown
4,929,039 A 5/1990 Thomas et al.
4,995,511 A 2/1991 Evans
D370,812 S 6/1996 Simmonds
6,186,324 B1 2/2001 Catterson

*Primary Examiner*—Ehud Gartenberg
*Assistant Examiner*—Kaushikkumar Desai
(74) *Attorney, Agent, or Firm*—Crossley Patent Law; Mark A. Crossley

(57) ABSTRACT

The toothbrush holder apparatus houses toothbrushes under a removable cover, with each toothbrush further housed within an individual compartment, under individual cover. Push button access is provided for each separate toothbrush. Pushing a given color-coded button causes the toothbrush within the related compartment to push upwardly against and open the hinged door above the compartment, thereby gaining access to the toothbrush within. Separate housing of each toothbrush prevents bacterial transfer from one brush to another. Particular attention is paid to the design of the toothbrush holder apparatus that results in an aesthetically pleasing appearance. The color coding provided for each toothbrush compartment further enhances entertainment while also providing instant identification of a toothbrush held within.

13 Claims, 5 Drawing Sheets

TOOTHBRUSH HOLDER APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

SPECIFICATION

To All Whom it May Concern

Be it known that I, Mahamanie Singh, a citizen of Guyana, have invented new and useful improvements in a toothbrush holder apparatus as described in this specification.

BACKGROUND OF THE INVENTION

It is desirable to cover toothbrushes exposed to an often less than sanitary environment, a fact well known. Additionally, multiple toothbrushes, such as those used by a family, are hard to keep separated and clean. For these reasons and more, a variety of toothbrush holders has been presented in the past. Mostly such holders are utilitarian, at best, and also do not feature separate, housed compartments for holding each brush. Few holders provide attractiveness or even entertainment, a factor often important in coercing a child to brush their teeth. The present apparatus provides compartmentalization for each toothbrush, along with other features that provide sanitary, aesthetic, and entertaining encasement for toothbrushes.

Field of the Invention

The present apparatus relates to toothbrush holders.

SUMMARY OF THE INVENTION

The general purpose of the toothbrush holder apparatus, described subsequently in greater detail, is to provide a toothbrush holder apparatus which has many novel features that result in an improved toothbrush holder apparatus which is not anticipated, rendered obvious, suggested, or even implied by prior art, either alone or in combination thereof.

To attain this, the toothbrush holder apparatus is provided in both basic and complete embodiments. The apparatus houses toothbrushes under a removable cover. The apparatus further houses each toothbrush within an individual compartment, under individual cover. Push button access is provided for each separate toothbrush. Pushing a given color-coded button causes the toothbrush within the related compartment to push upwardly against and open the hinged door above the compartment, thereby gaining access to the toothbrush within. The hinged cover over each compartment and the removable domed cover thereby provide extra ensured protection for each toothbrush within against bacterial invasion. Additionally, separate housing of each toothbrush prevents bacterial transfer from one brush to another. Particular attention is paid to the design of the toothbrush holder apparatus that results in an aesthetically pleasing appearance. Further, entertainment factors played a large part in the apparatus design, a feature especially important in coercing children into brushing their teeth. The color coding provided for each toothbrush compartment further enhances entertainment while also providing instant identification of a toothbrush held within, a feature especially appreciated by families.

Thus has been broadly outlined the more important features of the improved toothbrush holder apparatus so that the detailed description thereof that follows may be better understood and in order that the present contribution to the art may be better appreciated.

An object of the toothbrush holder apparatus is to house a plurality of toothbrushes, under removable cover.

Another object of the toothbrush holder apparatus is to house each toothbrush within an individual compartment, under individual cover.

A further object of the toothbrush holder apparatus is to provide push button access for each separate toothbrush An added object of the toothbrush holder apparatus is to be aesthetically pleasing.

And, an object of the toothbrush holder apparatus is to be entertaining.

A further object of the toothbrush holder apparatus is to provide color coding for each toothbrush compartment within.

These together with additional objects, features and advantages of the improved toothbrush holder apparatus will be readily apparent to those of ordinary skill in the art upon reading the following detailed description of presently preferred, but nonetheless illustrative, embodiments of the improved toothbrush holder apparatus when taken in conjunction with the accompanying drawings.

In this respect, before explaining the current embodiments of the improved toothbrush holder apparatus in detail, it is to be understood that the toothbrush holder apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved toothbrush holder apparatus. It is therefore important that the claims be regarded as including such equivalent constructions insofar as they do not depart from the spirit and scope of the toothbrush holder apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the toothbrush holder apparatus generally designated by the reference number 10 will be described.

Figure 1:
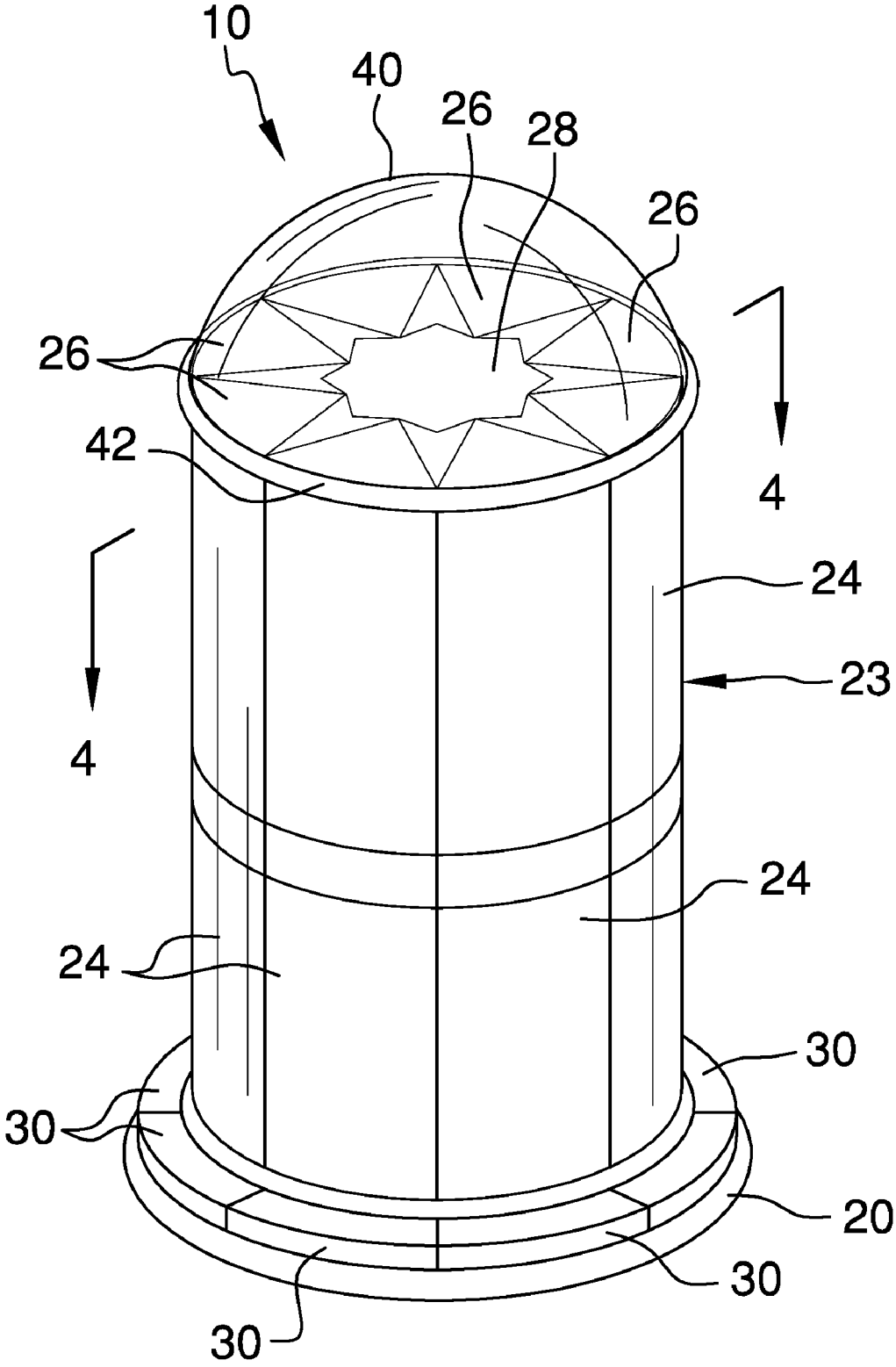
FIG. 1 is a perspective view.
Figure 2:
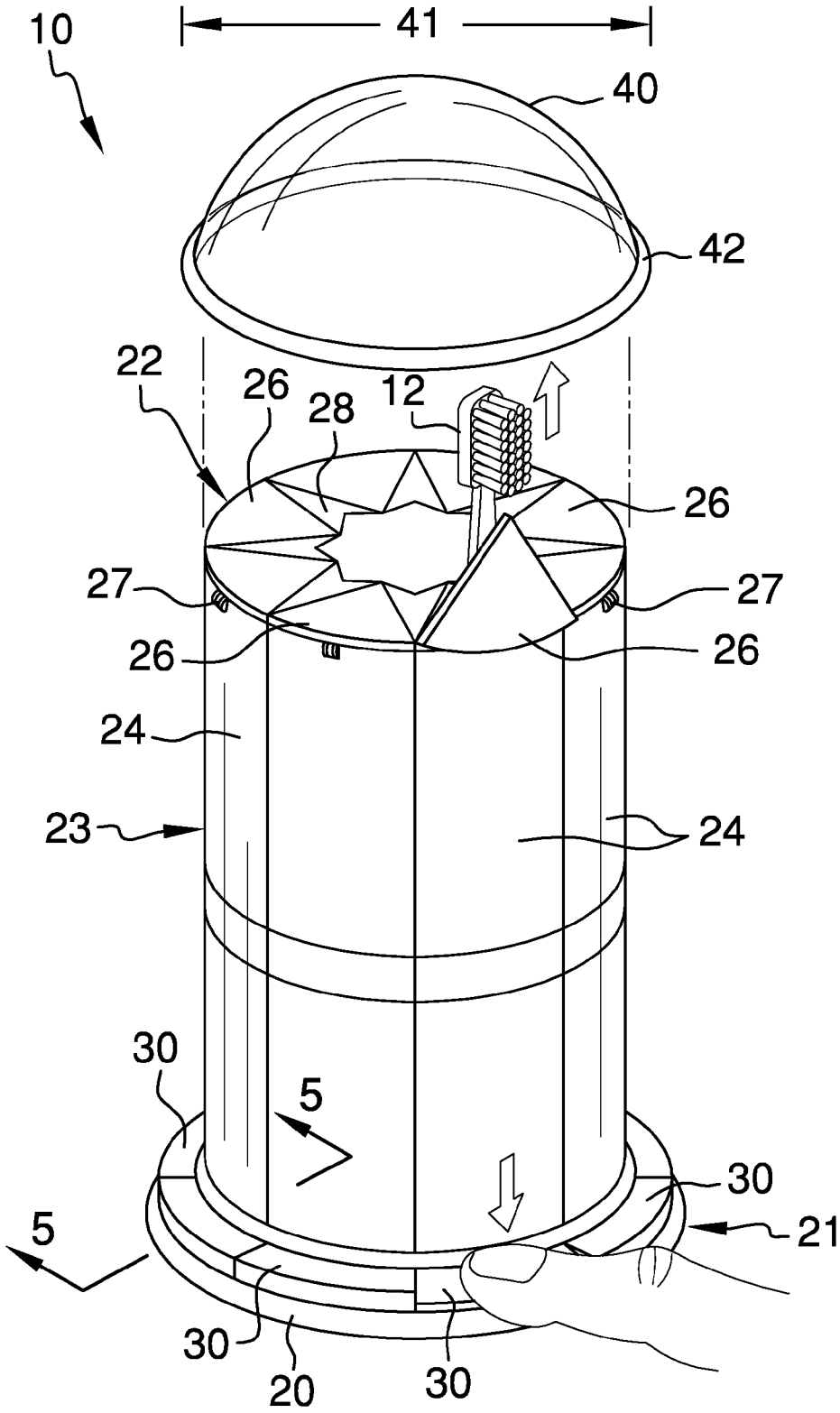
FIG. 2 is a perspective view, one push button depressed to elevate one toothbrush.
Figure 3:
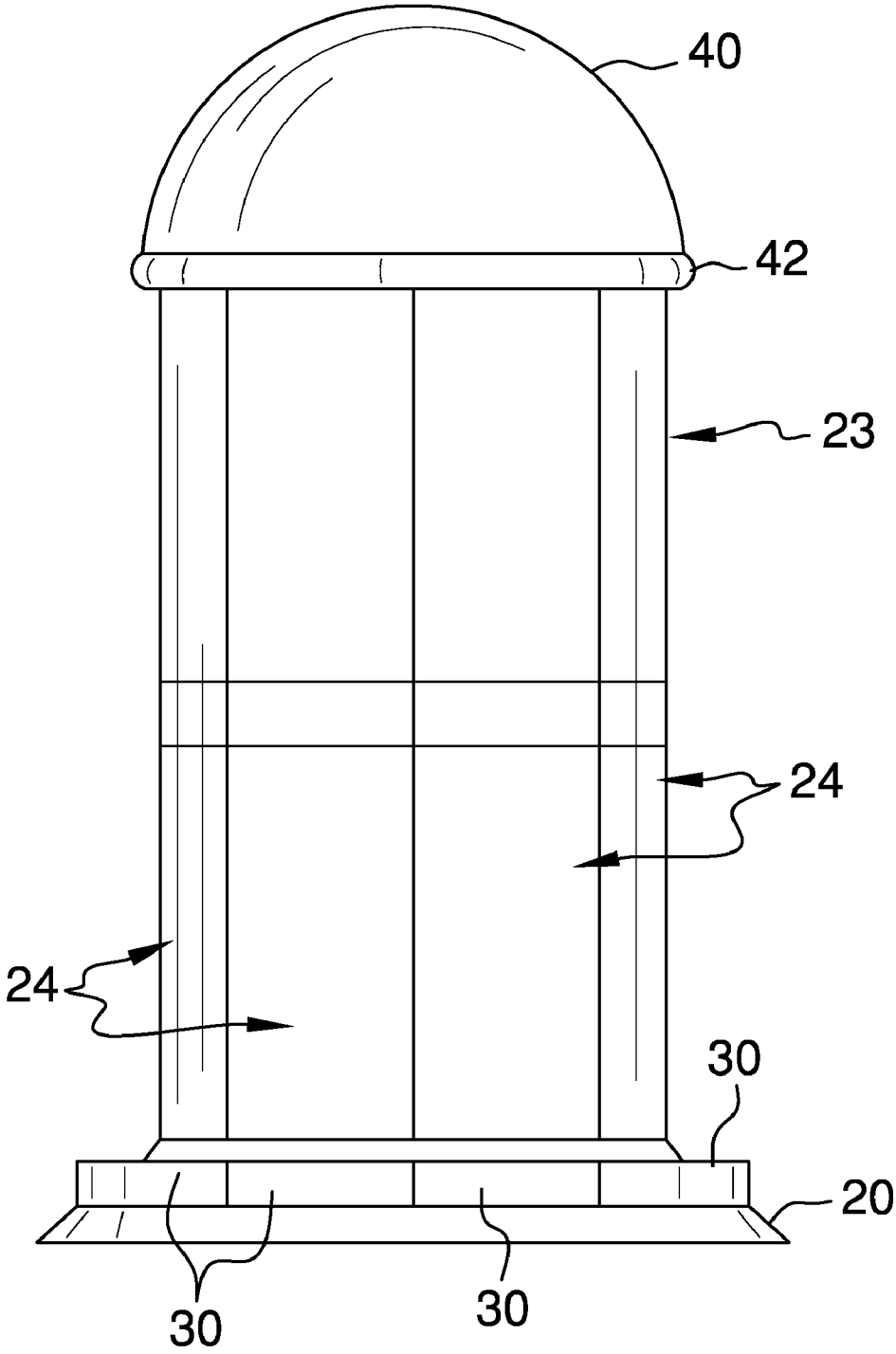
FIG. 3 is a lateral elevation view.

Referring to FIGS. 1, 2, and 3, the apparatus 10 provides for storage of toothbrushes 12, one under each hinged triangulated door 26. Push buttons 30 are individually color-coded. Doors 26 are color-coded to match each button 30. The domed lid 40 has a lid diameter 41. The lid flange 42 is disposed downwardly and outwardly on the domed lid 40. The lid flange 42 is removably fitted over the cylinder 23.

Figure 4:
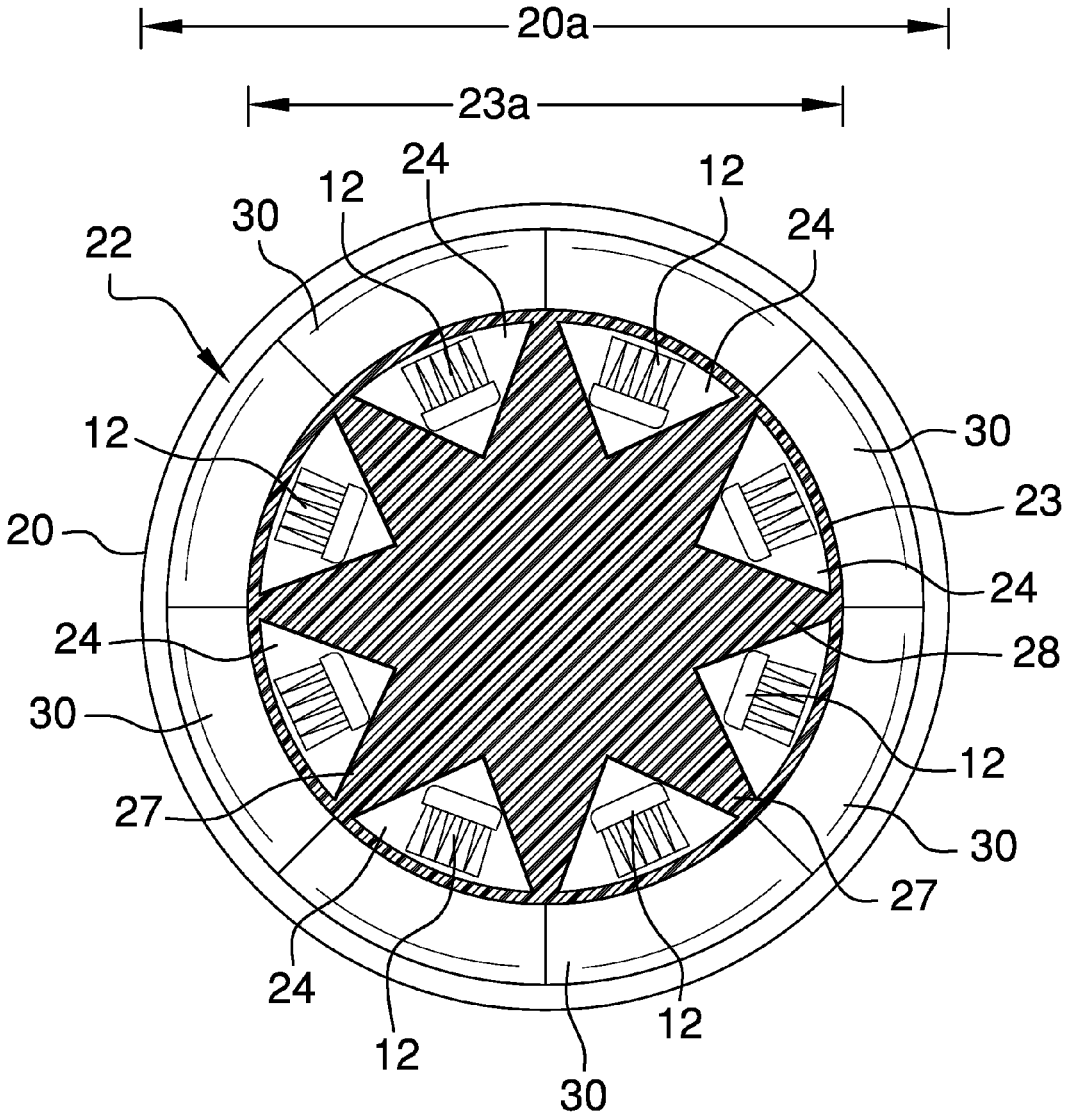
FIG. 4 is a cross sectional view of FIG. 1, taken along the line 4-4.
Figure 5:
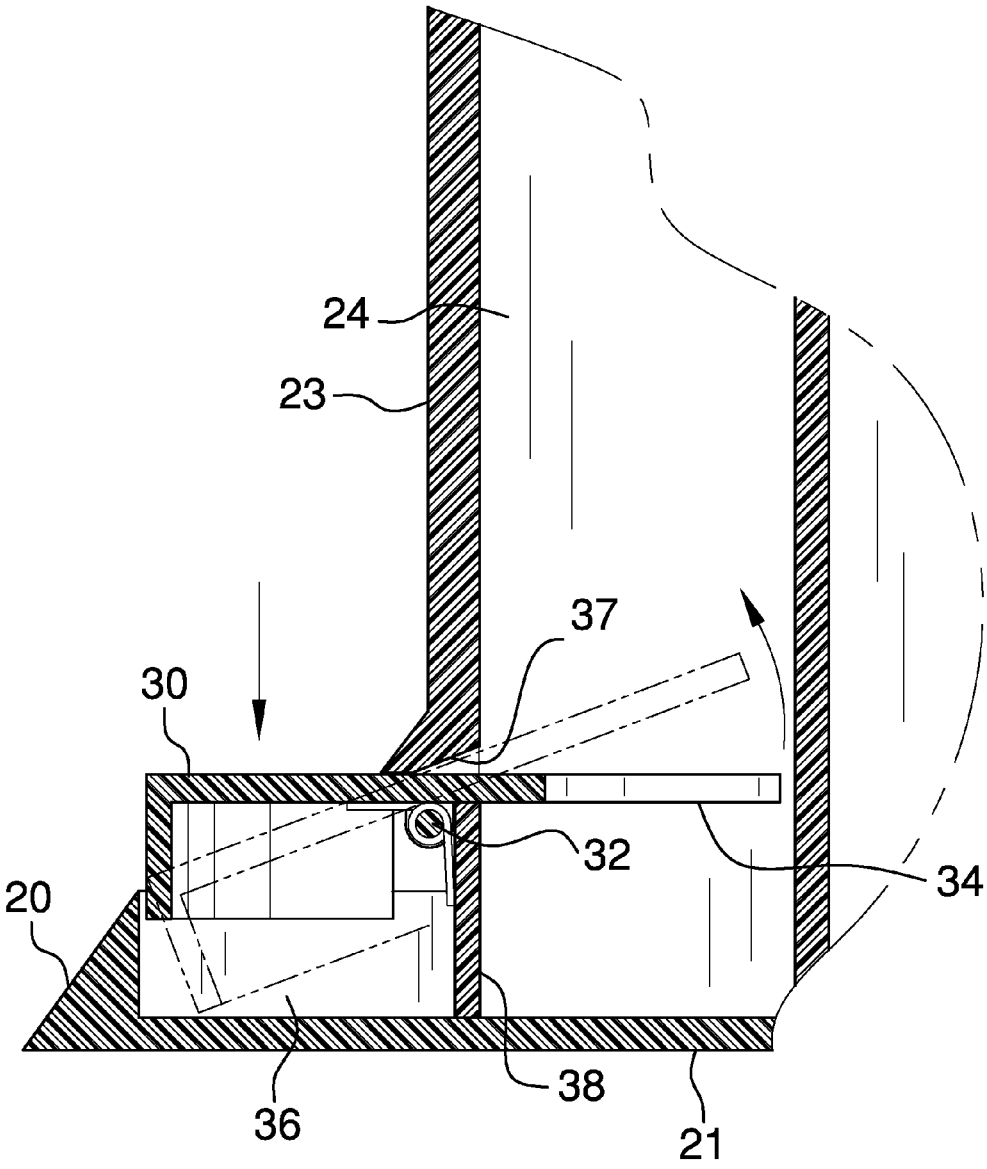
FIG. 5 is a partial cross sectional view of FIG. 2, taken along the line 5-5.

Referring to FIGS. 4 and 5 and continuing to refer to FIGS. 1-3, the apparatus further comprises the top 22 spaced apart from the bottom 21. The round tapered base 20 is disposed at the bottom 21. The base 20 has a base diameter 20*a*. The cylinder 23 is disposed atop the base 20 and extended to the top 22. The cylinder 23 has a cylinder diameter 23*a* less than the base diameter 20*a*. The domed lid 40 lid diameter 41 is approximately equal to the cylinder diameter 23*a*. The plurality of identical individual triangulated compartments 24 is distributed evenly with the cylinder 23. The compartment wall 38 is disposed downwardly and exteriorly within the base 20. The compartment wall 38 is coincidental with the cylinder diameter 23*a*. The upward taper 37 is disposed downwardly around the cylinder 23. The upward taper 37 is disposed directly above the compartment wall 38. An inwardly pointed triangulated hinged door 26 is disposed atop each compartment 24. A door spring 27 resists opening of each door 26. The multi-pointed star 28 is centered and radiated between the triangulated hinged doors 26. One color-coded push button 30 is disposed below each compartment 24. Each button 30 is disposed within a button pocket 36 within the base 20. Each button 30 is disposed outside of the cylinder diameter 23*a*. Each button 30 is extended into a lever 34 disposed within the compartment 24 adjacent to the button 30. A spring pivot 32 suspends each push button 30 exterior to each compartment 24. With each compartment 24, depression of the related button 30 elevates the lever 34, thereby elevating an existing toothbrush 12 within the compartment 24, thereby forcing the hinged door 26 upwardly by the toothbrush 12.

With respect to the above description then, it is to be realized that the optimum dimensional relationships for the parts of the toothbrush holder apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the toothbrush holder apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the toothbrush holder apparatus may be used.

Therefore, the foregoing is considered as illustrative only of the principles of the toothbrush holder apparatus. Further, since numerous modifications and changes will readily occur to those skilled in the art, it is not desired to limit the toothbrush holder apparatus to the exact construction and operation shown and described, and accordingly, all suitable modifications and equivalents may be resorted to, falling within the scope of the toothbrush holder apparatus.

What is claimed is:

1. A toothbrush holder apparatus, comprising, in combination:

a top spaced apart from a bottom;

a cylinder disposed atop a round base;

a plurality of compartments radially disposed within the cylinder;

a spring loaded hinged door disposed above each compartment;

a respective lever disposed within each compartment, at the bottom;

a respective push button integrally attached to each said lever;

each said compartment having a toothbrush;

wherein each push button selectively lifts a corresponding lever;

wherein each lever selectively pushes a corresponding toothbrush upwardly;

wherein each toothbrush selectively pushes open the corresponding hinged door.

2. The apparatus according to claim 1 wherein each push button of different color.

3. The apparatus according to claim 2 wherein each hinged door matches the color of the corresponding push button.

4. The apparatus according to claim 1 further comprising a domed lid removably placed on the cylinder.

5. The apparatus according to claim 2 further comprising a domed lid removably placed on the cylinder.

6. The apparatus according to claim 3 further comprising a domed lid removably placed on the cylinder.

7. The apparatus according to claim 1 wherein each compartment has a triangular cross-section;

wherein each hinged door triangular shaped, wherein each hinged door covers a compartment.

8. The apparatus according to claim 2 wherein each compartment has a triangular cross-section;

wherein each hinged door is triangular shaped, wherein each hinged door covers a compartment.

9. The apparatus according to claim 3 wherein each compartment has a triangular cross-section;

wherein each hinged door is triangular shaped, wherein each hinged door covers a compartment.

10. The apparatus according to claim 4 wherein each compartment has a triangular cross-section;

wherein each hinged door is triangular shaped, wherein each hinged door covers a compartment.

11. The apparatus according to claim 5 wherein each compartment has a triangular cross-section;

wherein each hinged door is triangular shaped, wherein each hinged door covers a compartment.

12. The apparatus according to claim 6 wherein each compartment has a triangular cross-section;

wherein each hinged door is triangular shaped, wherein each hinged door covers a compartment.

13. A toothbrush holder apparatus, comprising, in combination:

a top spaced apart from a bottom;

a round tapered base disposed at the bottom, the base having a base diameter;

a cylinder disposed atop the base and extended to the top, the cylinder having a cylinder diameter less than the based diameter;

a plurality of identical individual compartments disposed within the cylinder, each compartment having a triangular cross-section;

each said compartment having a toothbrush;

a compartment wall disposed downwardly and exteriorly within the base, the compartment wall coincidental with the cylinder diameter;

an upward taper disposed downwardly around the cylinder, the upward taper disposed directly above the compartment wall;

a respective inwardly pointed triangular shaped hinged door disposed atop each compartment;

a respective door spring resisting an opening of each hinged door;

a multi-pointed star center centered and radiated between the hinged doors;

a respective color-coded push button disposed below each compartment, each push button disposed within a push button pocket disposed within the base, each push button disposed outside of the cylinder diameter, each push button in communication with a respective one of the compartments;

whereby depression of one of the push buttons elevates a respective lever;

wherein elevation of the lever forces a respective toothbrush upwardly, whereby a corresponding one of the hinged doors is forced to open upwardly;

a domed lid having a lid diameter approximately equal to the cylinder diameter;

a lid flange disposed downwardly and outwardly on the domed lid, the lid flange removably fitted over the cylinder.

* * * * *